US007998310B2

(12) United States Patent
Gustavsson et al.

(10) Patent No.: US 7,998,310 B2
(45) Date of Patent: Aug. 16, 2011

(54) METHOD FOR IMPREGNATING CHIPS

(75) Inventors: Lennart Gustavsson, Karlstad (SE); Jonas Saetherasen, Hammaro (SE); Vidar Snekkenes, Karlstad (SE)

(73) Assignee: Metso Paper Sweden AB, Karlstad (SE)

( * ) Notice: Subject to any disclaimer, the term of this patent is extended or adjusted under 35 U.S.C. 154(b) by 869 days.

(21) Appl. No.: 11/570,901

(22) PCT Filed: Jun. 21, 2005

(86) PCT No.: PCT/SE2005/000959

§ 371 (c)(1),
(2), (4) Date: Dec. 19, 2006

(87) PCT Pub. No.: WO2006/001758

PCT Pub. Date: Jan. 5, 2006

(65) Prior Publication Data

US 2008/0277081 A1 Nov. 13, 2008

(30) Foreign Application Priority Data

Jun. 23, 2004 (SE) ..... 0401624

(51) Int. Cl.
*D21C 3/26* (2006.01)
*D21C 1/10* (2006.01)

(52) U.S. Cl. ..... 162/19; 162/17; 162/241; 162/246

(58) Field of Classification Search ..... 162/17, 162/241, 19, 242, 246
See application file for complete search history.

(56) References Cited

U.S. PATENT DOCUMENTS 3,532,594 A 10/1970 Richter
6,129,816 A * 10/2000 Sheerer et al. ..... 162/237
2003/0000660 A1 * 1/2003 Gustavsson et al. ..... 162/24

FOREIGN PATENT DOCUMENTS

WO WO03106765 12/2004

OTHER PUBLICATIONS

Gullichsen et al., Chemical Pulping 6A, 1999, Fapet Oy, p. A535.*

* cited by examiner

*Primary Examiner* — Matthew Daniels
*Assistant Examiner* — Anthony Calandra
(74) *Attorney, Agent, or Firm* — Rolf Fasth; Fasth Law Offices

(57) ABSTRACT

A method for the impregnation of untreated chips during the manufacture of chemical pulp. The untreated chips are fed without preceding steam treatment into an impregnation vessel that has an upper part with a first area (A1) and a lower part with a second area (A2) that is larger than the first area (A1) by a factor of at least $\sqrt{2}$. The chips establish in the upper part a level of chips that is located at a level (h) above a level of fluid consisting of liquor. The chips after passage of the upper part pass through a transitional part, where an increase in area from the first area (A1) to the second area (A2) takes place, and it is here that the angle of repose of the chips is reduced.

4 Claims, 2 Drawing Sheets

METHOD FOR IMPREGNATING CHIPS

PRIOR APPLICATION

This application is a U.S. national phase application based on International Application No. PCT/SE2005/000959, filed 21 Jun. 2005, claiming priority from Swedish Patent Application No. 0401624-2, filed 23 Jun. 2004.

TECHNICAL AREA

The present invention relates to a method and arrangement for impregnation of chips.

THE PRIOR ART

The impregnation of untreated chips without a preceding steam treatment step is known, where the untreated chips are contiguously fed in the top of an impregnation vessel through an inlet. Impregnated chips are subsequently fed out through an outlet arranged at the bottom of the vessel. One example of such an impregnation method is described in more detail in SE 518738.

It is also known that untreated chips have an angle of repose of approximately 45°. This means that the chips have a tendency to form arches, which in turn means that the chip fragments are packed onto each other at an angle to the horizontal plane of 45°. This then in its turn means that a stirrer at the bottom of the impregnation vessel is subjected to large shear forces against the packed chips. These large shear forces may result in the failure of at least one of the stirrer and the motor that drives the stirrer.

A conventional chip bin 1 is shown in U.S. Pat. No. 6,089,417 in which untreated chips are fed in through a feed 6. The chips are treated with steam through a steaming vessel 7 in order to be subsequently fed out from the chip bin through an outlet arranged at the bottom of the chip bin 1. As is the case for the great majority of chip bins of this type, the cross-sectional area of the chip bin is greater at the top and at the inlet, and subsequently becomes more narrow towards the bottom and the outlet.

A digester or an impregnation vessel for the treatment of cellulose pulp is shown in U.S. Pat. No. 6,451,163 B2. The vessel has one part with a first diameter for storage or treatment of the material above the outlet, with a second diameter that is at least 20% less than the first diameter. This design achieves, according to the patent, less compression of the material and a reduced requirement for power of the stirrer. Even if the compression of the material is reduced, the design is not suitable for the handling of untreated chips in an impregnation vessel. In this case, the angle of repose of the chips would increase from 45° to be closer to 90° following passage of the second diameter, and an increased power for the stirrer would in this way be required.

FIG. 2 of SE 343344 shows a continuous digester with a narrow impregnation zone (a). The narrow top passes into a conical part 67 in the lower additional digestion zone 11 of the digester. The diameter d of the narrow impregnation zone is 15-25% lower than the diameter D of the digestion zone. The purpose of having a diameter d in the impregnation zone that is considerably smaller than the diameter D of the digestion zone is to counteract the transfer of heat from the digestion zone to the impregnation zone. This means that the requirement for cooling at the lower end of the impregnation zone is reduced. The chips are fully digested and softened at the bottom of a continuous digester, in such a manner that individual chip fragments can be easily disintegrated using mild force. It would be easy to deform the chip fragments if it were possible to remove them from the bottom of the digester, and the problem with locking between undeformed chips and the stirrer would simply not arise.

A traditional system is shown in U.S. Pat. No. 4,432,836 in which the chips are first steamed in a steaming vessel 14 in order to expel air and water. The chips are then formed into a slurry in a conduit 18 and led to a first impregnation vessel 1. While it is true that the impregnation vessel 1 in this case does have an increase in area at its central part, this is located at a position at which the chips or bagasse is drenched with impregnation fluid, in an impregnation vessel that has been filled hydraulically.

There are here, however, no problems with the formation of arches and large angles of repose of the chips or bagasse, since the feed screw 27 presses the chips downwards, and the chips or bagasse subsequently slowly sink (flutter down like a leaf in the autumn) into the impregnation fluid.

Impregnation vessels with an increase in area are shown independently in SE 518 738 and in U.S. Pat. No. 3,532,594, where the level of fluid is located above the increase in area. This means that the chips will be compressed due to the buoyancy obtained from the fluid, and this in turn means that the chips are locked between themselves. A consequence of this is that the angle of repose will be significantly reduced after the increase in area, and this has the consequence that large shear forces will be exerted on a stirrer at the bottom of the vessel.

PURPOSE OF THE INVENTION

The principal purpose of the present invention is to achieve an invention that fully or partially alleviates the problem of the chips in an impregnation vessel becoming packed at the bottom of the vessel with an angle of repose that lies around 45°, and by the locking of undeformed chip fragments making stirring and output more difficult.

A second purpose is to reduce the shear forces that influence the stirrer by a more advantageous configuration of chips.

A third purpose is to reduce the risk that at least one of the stirrer and the stirrer motor becomes overloaded and fails.

A fourth purpose is to reduce the power requirement of the motor of the stirrer.

A fifth purpose is to be able to use a smaller and cheaper motor to drive the stirrer.

A sixth purpose is to be able to apply a simpler and cheaper design for the stirrer.

DETAILED DESCRIPTION OF THE INVENTION

The concept "untreated chips" will bemused in the following detailed description. The term "untreated chips" is here used to denote chips that have not undergone any pre-treatment such as steam treatment or similar, before the chips are fed into an impregnation vessel in order to be impregnated. The term "angle of repose" will also be used. The term "angle of repose" is here used to denote the angle between a plane in the longitudinal direction of the chips and a horizontal plane at which the chips fall down and form an arch.

Figure 1:
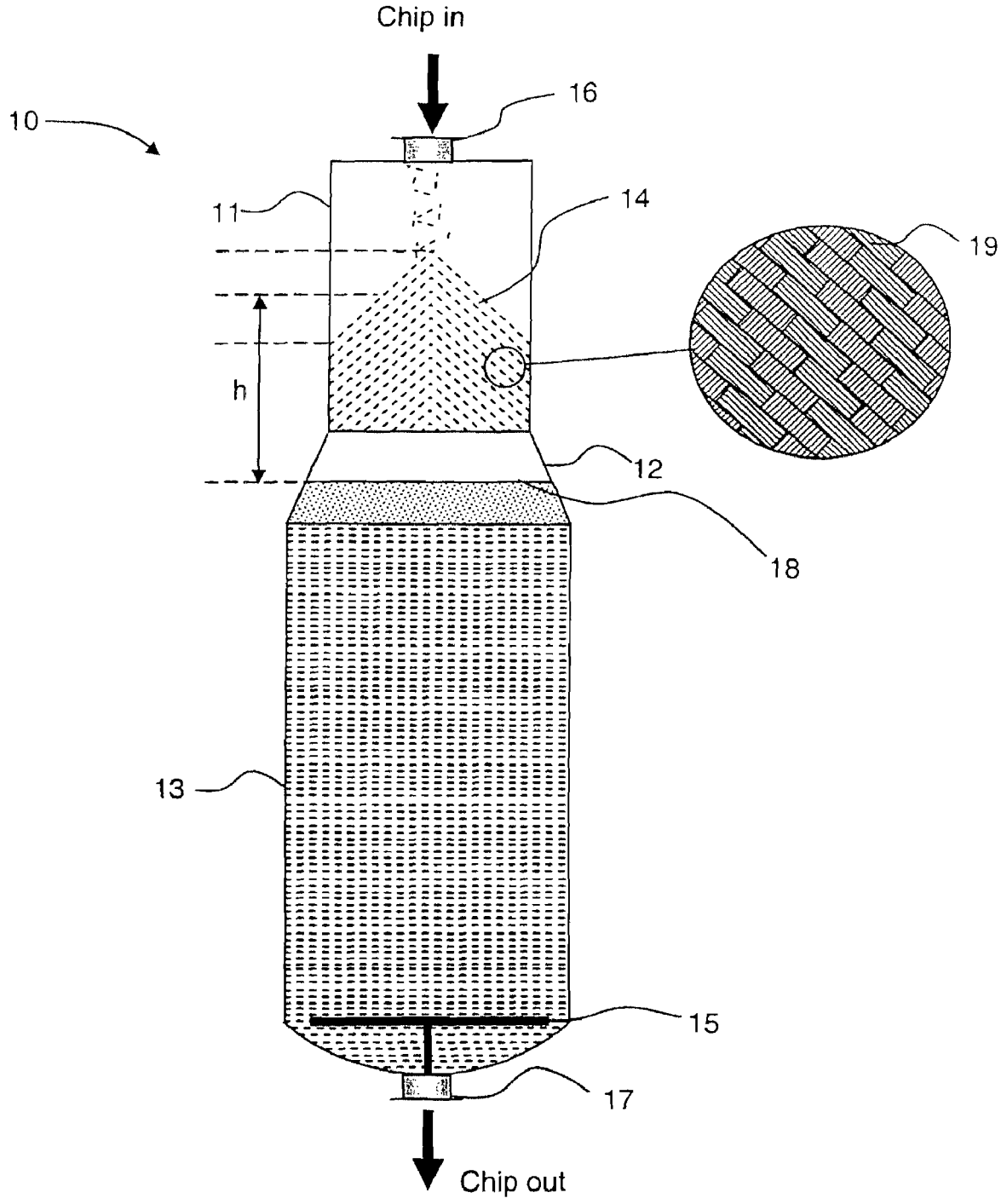
FIG. 1 shows a schematic drawing of an impregnation vessel according to the invention.

FIG. 1 shows an essentially cylindrical vertically arranged impregnation vessel 10 for the impregnation of untreated chips during the manufacture of chemical pulp.

The impregnation vessel 10 has an upper part 11 with a first area $A_1$ and a lower part 13, with a second area $A_2$. The second area $A_2$ is larger than the first area $A_1$ by a factor of at least $\sqrt{2}$, i.e. $A_2 \geqq \sqrt{2} \cdot A_1$.

A conical transitional part 12 is arranged between the upper part 11 and the lower part 13, where an increase in area from the first area $A_1$ to the second area $A_2$ takes place.

A motor-driven stirrer 15 is arranged at the bottom of the lower part 13 in order to mix chips and liquor. (The motor of the stirrer is not shown in the drawing.)

Untreated chips 19 are continuously fed into the impregnation vessel 10 through an inlet 16 arranged in the upper part 11. A chips level 14 is established below the inlet 16 in the upper part 11, where the 19 have an angle of repose of approximately 45°. When the untreated chips 19 have passed the upper part 11 and entered the conical transitional part 12, the angle of repose of the chips is reduced as a consequence of the increase in area in the conical transitional part 12. The increase in area from the first area $A_1$ to the second area $A_2$ in the transitional part 12 may take place in a continuous manner, i.e. conically, but it may also take place discontinuously in one or several steps, as is indicated by the sections 12', 12" and 12'''.

After passage through the transitional part 12 and when the chips have entered the lower part 13, the angle of repose has been considerably reduced to less than 10° or less than 5°. The fragments 19 of chips are here lying essentially horizontally, and thus the angle of repose is approximately 0°.

A fluid level 18 is established below the level 14 of chips with the purpose of impregnating the untreated chips. In order for it to be possible for untreated chips to sink down into the impregnation fluid, the level 14 of chips must lie at a minimum distance h (shown in FIG. 1) above the fluid level 18. The chips in this way fall and form a configuration of chips that has a lower angle of repose. It is appropriate that the height h that lies between the point of the level of chips and the height of the bottom $h_b$ (see FIG. 1) is 2 metres, and preferably 3-5 metres.

The retention time of the chips in the liquor phase in association with the increase in area is less than 20% of the total retention time of the chips in the liquor phase. The total time for the retention of the chips in the liquor phase varies between 10 and 90 minutes.

At least 50% of the increase in area from the first area $A_1$ to the second area $A_2$ is located above the level 18 of fluid. Since the increase in area commences well before the chips have sunk down into the impregnation fluid, the angle of repose of the chips will also be broken early, due to the weight of the chips achieving full effect, and not being counteracted by the lifting force with which the fluid influences the chips.

Impregnated chips are continuously fed out from the impregnation vessel 10, together with liquor, through an outlet 17 arranged at the bottom of the lower part 13 below the stirrer 15.

Figure 2:
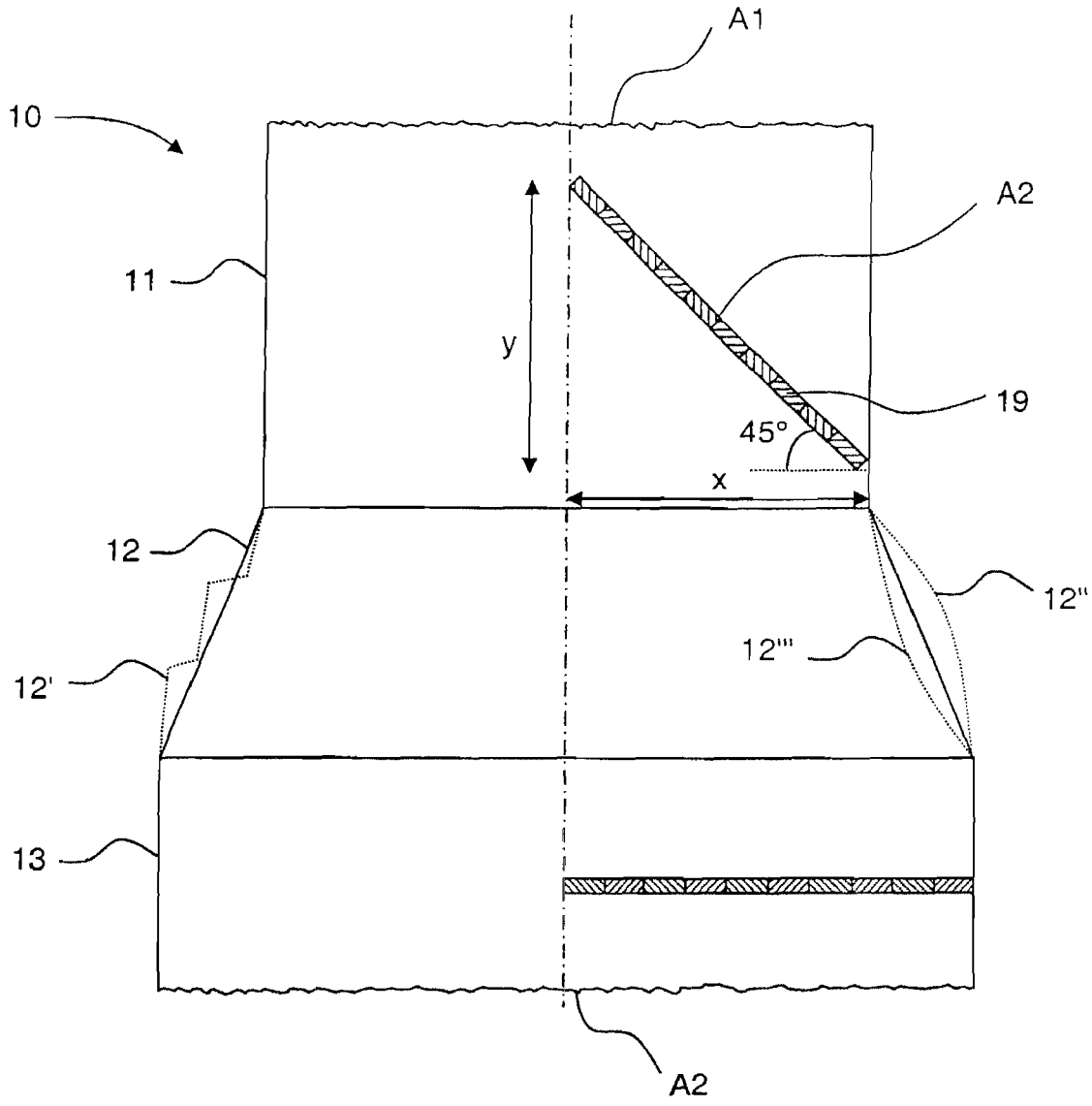
FIG. 2 shows schematically in a drawing how the angle of repose of the fragments of chips decreases after the increase in area, according to the invention.

FIG. 2 shows schematically an impregnation vessel 10 according to the invention in which untreated fragments of chips have formed an arch with an angle of repose of 45° in the upper part 11 (only a single layer of chips in one lo half of the vessel is shown in the drawing). The configuration of the fragments of chips can be compared with a cone in which x corresponds to the radius of the bottom of the cone and where y corresponds to the height of the cone. The relationship y=x is valid, since the fragments of chips have an angle of repose of 45°.

The first area $A_1$ of the upper part 11 of the impregnation vessel 10 will then be given by:

$$A_1 = \pi \cdot x^2 \tag{1}$$

In order for it to be possible for fragments of chips to fall down and adopt a horizontal position in association with the transitional part 12, it is necessary that the lower part 13 has an area that is at least as large as the covering area of the cone that the fragments of chips formed in the upper part 11. The second area $A_2$ of the lower part 13 of the impregnation vessel 10 can therefore be obtained from:

$$A_2 = \pi \cdot x \cdot \sqrt{x^2 + y^2} \tag{4}$$

The relationship y=x is valid, since the angle of repose is 45°, giving:

$$A_2 = \pi \cdot x^2 \cdot \sqrt{2}$$

$A_2$ is then related to $A_1$ by the following relationship:

$$A_2 = \sqrt{2 \cdot A_1} \tag{5}$$

Thus the second area $A_2$ must be greater than the first area $A_1$ by a factor of at least $\sqrt{2}$, in order to achieve the best results. i.e. a reduction repose such that the fragments of chips adopt a horizontal position in the lower part 13.

The following advantages over the prior art are achieved with the invention:

The shear forces that affect the stirrer 15 are reduced, due to the reduction in the angle of repose of the fragments of chips. This means that:

there is a lower risk that at least one of the stirrer 15 and the motor of the stirrer fail.

the power requirement of the motor that drives the stirrer 15 is significantly reduced.

a smaller and cheaper motor can be used to drive the stirrer 15.

the design of the stirrer 15 is simpler and cheaper.

The invention is not limited to the embodiments shown. Several variants are possible within the framework of the claims.

While the present invention has been described in accordance with preferred compositions and embodiments, it is to be understood that certain substitutions and alterations may be made thereto without departing from the spirit and scope of the following claims.

The invention claimed is:

1. A method for impregnating untreated chips during the manufacture of chemical pulp, comprising:

continuously feeding untreated chips without a preceding steam treatment into an impregnation vessel, the impregnation vessel having an upper cylindrical part with a first inner cross-sectional area and a lower cylindrical part with a second inner cross-sectional area, a bottom of the lower cylindrical part having an outlet defined therein, establishing a chip level of chips in the upper cylindrical part, the chip level being located at a distance (h) above a fluid level consisting of a liquor and the untreated chips having an angle of repose of approximately 45 degrees when disposed in the first inner cross-sectional area, the chips, after passing through the upper cylindrical part, passing through a transitional part, establishing a liquid level in the transitional part, impregnating the untreated chips with a liquor while the chips sinking down into the second inner cross-sectional area, providing an increase of an area from the first inner cross-sectional area to the second inner cross-sectional area in the transitional part, increasing the second inner cross-sectional area compared to the first inner cross-sectional area so that the second inner cross-sectional area is greater than the first inner cross-sectional area by a factor of at least $\sqrt{2}$, reducing an angle and locating at least 50% of the increase in an area between the first inner cross-sectional area and the second inner cross-sectional area above the fluid level;

reducing the angle of repose of the impregnated chips in the second inner cross-sectional area to less than 10 degrees so that the impregnated chips are essentially horizontally disposed in the second inner cross-sectional area; and feeding out impregnated chips from the impregnation vessel, together with the liquor, through the outlet arranged at the bottom of the lower cylindrical part.

2. The method according to claim 1, wherein a retention time of the chips in a liquor phase in association with the increase in inner cross-sectional area is less than 20% of a total retention time of the chips in the liquor phase.

3. The method according to claim 1 wherein the method further comprises setting the angle of repose of the chips in the lower part to less than 5°.

4. The method according to claim 1 wherein the method further comprises setting the angle of repose of the chips in the lower part to approximately 0 degrees.

* * * * *